United States Patent [19]

Sturnick

[11] Patent Number: 4,529,188

[45] Date of Patent: Jul. 16, 1985

[54] SHEET FEEDING AND REGISTRATION APPARATUS

[75] Inventor: Gerard R. Sturnick, Rochester, N.Y.

[73] Assignee: Xerox Corporation, Stamford, Conn.

[21] Appl. No.: 510,528

[22] Filed: Jul. 5, 1983

[51] Int. Cl.[3] ..... B65H 3/06; B65H 5/06; B65H 9/06

[52] U.S. Cl. ..... 271/10; 271/114; 271/119; 271/242

[58] Field of Search ..... 271/10, 16, 110-111, 271/113-114, 116, 118-119, 155-156, 242-246, 256

[56] References Cited

U.S. PATENT DOCUMENTS

| | | | |
|---|---|---|---|
| 3,981,497 | 9/1976 | Feinstein et al. | 271/126 |
| 4,015,523 | 4/1977 | Evans et al. | 101/233 |
| 4,268,163 | 5/1981 | Doi et al. | 355/14 SH |

FOREIGN PATENT DOCUMENTS 1603067 11/1981 United Kingdom .

*Primary Examiner*—Bruce H. Stoner, Jr.
*Assistant Examiner*—Lawrence J. Goffney, Jr.

[57] ABSTRACT

A drive assembly for a stalled roll sheet feeding device is illustrated. It comprises a registration roll and a feed roll driven in timed sequence each with a control collar comprising a clutch to engage and disengage the respective shaft and each collar having control stops positioned to interact with a control arm pivotally mounted between them which with a solenoid actuator selectively pulls one end of the control arm down releasing the other and, when the solenoid is deenergized a spring positively retracts the control arm from engagement with the control collar. In a preferred embodiment the sheet feed roll comprises a segmented feed roll and a cam actuated spring is used to multiply the positive retraction force supplied to the control arm when it is retracted from engagement with the control collar.

11 Claims, 6 Drawing Figures

SHEET FEEDING AND REGISTRATION APPARATUS

BACKGROUND OF THE INVENTION

The present invention relates to sheet feeding and registration apparatus and in particular to a stalled roll registration apparatus.

The automatic reproducing machines using electrostatographic reproduction methods available on the market place today have a wide variety of capabilities and utilities. They extend all the way from the high speed multi-functioned 9000 family of products available from Xerox Corporation to the smaller more compact machines which rely on the manual feeding of documents and copy paper. In all these devices, it is desirable to have reliably consistent feeding of copy sheets. It is desirable for example in any paper feeder to know and control with some degree of reliability where the paper is at all times. This is to ensure accurate registration and a minimum amount of skew of the lead edge of the paper, in relationship to the lead edge of the image on the photoconductor imaging layer. One of the many type of paper feeders that has been used, particularly in the smaller more compact copiers is that which is referred to as the stalled roll paper feeding and registration system. In such a system the lead edge of a copy sheet is separated from the input paper stack and fed by a feed roll or other feed means to a stalled registration roll, typically to the nip formed between such a roll and an idler roll in contact with it where the lead edge is deskewed and the paper is registered in the shortest distance from the feed supply, thereby ensuring accuracy of registration and deskewing. In the Xerox 1020 machine, for example, the paper feeder and registration functions are accomplished via a sheet separator feed roll module apart from a stalled roll registration module. Each of the driven shafts with the feed roll and the registration roll have a clutching mechanism with a pivoted arm between the two shafts controlling the two shafts. Each shaft has a control collar with multiple teeth and there is a switch in the paper path to identify paper location in response thereto to activate a solenoid which in turn activates the control arm and thereby the individual control collars. This device requires a complex, costly electronic controller device to look at and sense what is going on with regard to the sheet being fed and to switch the feed roll and registration roll on and off. In addition, the retraction of the control arm from the control collar is inconsistent with respect to time on the registration roll clutch thereby leading to the propensity for increased mis-registration with the image on the imaging layer. Furthermore with the feed system used in the Xerox 1020, for example, a separate means to retract the feed roll from the sheet supply must be provided, otherwise the top sheet being fed from the supply of sheets will be under the influence of both the feed roll and the registration roll, again giving rise to the possibility of poor registration and accuracy with regard to the lead edge of the image on the imaging surface.

PRIOR ART

U.S. Pat. No. 3,981,497 (Feinstein et al) discloses an automatic alignment device including take-off rollers, sheet separator nip rollers, and a clutch solenoid control. The picker rollers and sheet separator nip rollers rotate at the same time under the control of the clutch.

They use the solenoid to lift and drop the picker roller in contact with the document stack. There is no disclosure of using a pivotally mounted cammed spring arm multiplier, nor is there any disclosure of a wrapped spring actuated clutch control collars for feed roll and sheet separator roll.

SUMMARY OF THE INVENTION

It is an object of the present invention to provide a relatively simple, compact, low cost, sheet feeding and registration apparatus.

It is a further object of the present invention to provide a highly reliable, accurate, simple sheet feeding and registration apparatus.

It is a further object of the present invention to provide a sheet feeding and registration apparatus with a very short paper path from the paper supply to registration, thereby minimizing skew and registration error, and providing consistency of driven displacement between feed roll and registration roll.

It is a further object of the present invention to provide a sheet registration apparatus which feeds successive sheets through the registration nip in consistently timed relationship.

It is a further object of the present invention to overcome the inherent inconsistent solenoid capacitance which causes variation in clutch engagement through the use of a force multiplying device that ensures consistent response to solenoid deenergization.

These and other objects are attained with a sheet feeding and registration apparatus for feeding sheets from a stack of sheets which includes a sheet registration roll and a sheet feed roll both axially mounted on drive shafts together with a drive assembly to drive the feed roll and the registration roll in a timed sequence, the drive assembly includes control collars mounted on each of said feed roll shaft and the registration roll shaft, each collar comprising a clutch means to engage and disengage the feed roll shaft and the registration roll shaft with the drive means, and also having control stops selectively positioned on their surfaces and a control arm pivotally mounted between the feed roll collar and the registration roll collar, each end of the control arm having means to respectively engage the control stops on the feed roll and registration roll collar, together with solenoid means to selectively pull the end of the control arm adjacent the feed roll down when activated thereby releasing the initial stop of feed roll control collar, while simultaneously engaging one of the stops on registration roll contact collar, and further including means to positively retract the control arm from an engagement with said registration roll control collar when the solenoid is deenergized.

In a further aspect of the present invention, means are provided to multiply the positive retraction force supplied to the control arm when it is retracted from engagement with the registration roll control collar.

In a further aspect of the present invention, a spring means is attached to the end of the control arm in operative association with the registration roll control collar, the other end of the spring is connected to a lever which is pivotally mounted between said feed roll and registration roll, the opposite end of the lever being a cam follower in operative association with a cam surface on the feed roll output hub thereby providing incremental extension in said spring when the solenoid is deenergized and providing an additional force to retract the control arm from the control collar on the registration roll shaft when a solenoid is deenergized.

In a further aspect of the present invention, the feed roll comprises a segmented feed roll and the clutch means comprises a wrap spring clutch.

For a better understanding of the invention as well as other objects and further features thereof, reference is made to the following drawings and description.

DESCRIPTION OF THE PREFERRED EMBODIMENT

The invention will now be described in detail by reference to a preferred embodiment of the sheet feeding and registration apparatus.

Figure 1:
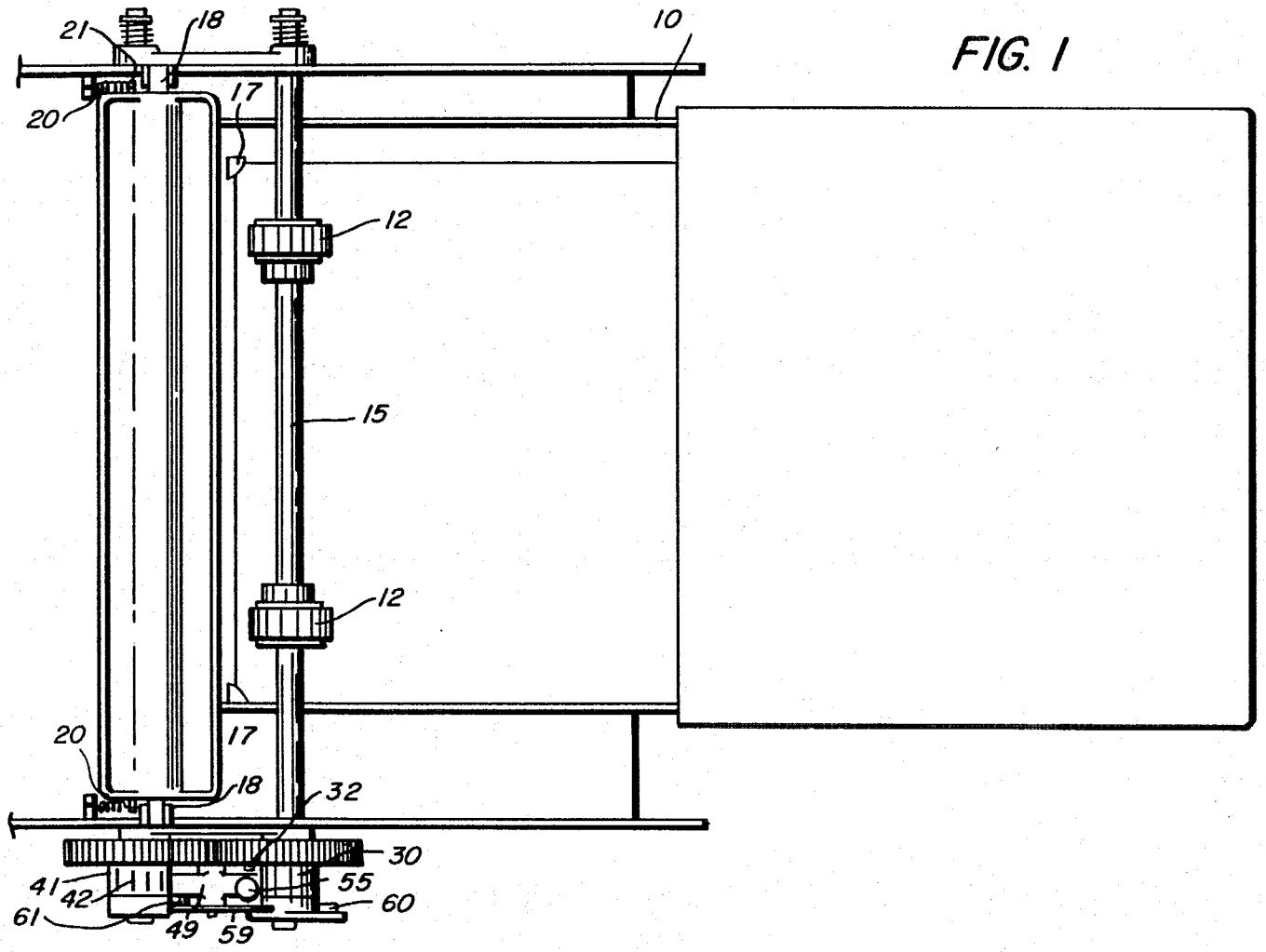
FIG. 1 is a plan view of the sheet feeder and registration apparatus together with a sheet supply cassette.
Figure 2:
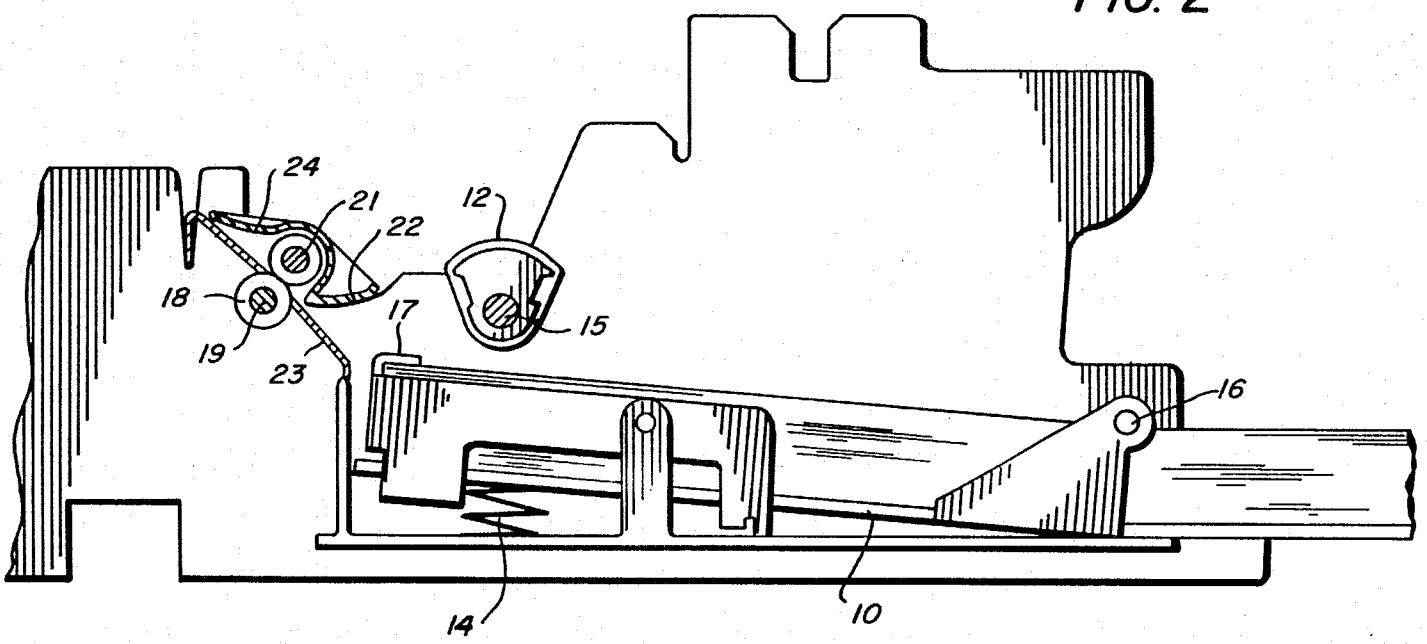
FIG. 2 is a cross-sectional side view of an exemplary sheet feeder employing the present invention.

As illustrated generally in FIGS. 1 and 2 where a copy sheet cassette 10 which is capable of containing a number of sheets (up to 250, for example) to be separated and fed in a forward direction is urged upwardly into sheet feeding engagement with the segmented feed rolls 12 rotating on shaft 15. The cassette when inserted in the feeder provides a loading mechanism by which the lead edge of the sheets in the cassette are forced upward by compression springs 14 into contact with the corner snubbers 17 placed on each of the forward corners of the cassette. The corner snubbers provide forward buckle sheet separation as well as top of stack positioning. Single sheets of paper, for example, are fed out of the cassette by the two segmented feed rolls 12 rotating on the feed roll shaft 15 over the corner snubbers into a stalled roll registration nip formed by registration roll 18 and idler roll 21 biased together by springs 20 and driven in contact with the registration roll. The top sheet is fed when the frictional surface of the segment contacts the top sheet. During the path of travel of the sheet from the feed roll to the registration nip the lead edge of the sheet is guided by upper sheet guide 22 and lower sheet guide 23. In a stalled registration roll system when the lead edge of the sheet being fed arrives at the registration nip, the registration roll is not being driven and thus a slight buckle is formed in the sheet.

After formation of the buckle the rotation of the feed rolls cease and the sheet is held stationary until the appropriate signal activates the registration roll at which time the feed roll and registration roll are simultaneously driven forward with the lead edge of the sheet going into the registration nip between the registration roll 18 and the idler roll 21 and emerging from the nip to follow the exit sheet guide 24 to the transfer station (not shown) where a toner image on a photoconductive imaging layer may, for example, be transferred in registration to the lead edge of the copy sheet. In the illustrated embodiment the feed roll is a segmented feed roll by which we mean only a portion of the roll contacts the top sheet of a stack of sheets and separates it from the stack, feeding it in a forward direction. During the initial separation the segmented feed roll is rotated clockwise about 230° from the initial position shown in FIG. 2 to separate and feed the sheet from the input stack to the registration nip and form a slight buckle. Subsequent to the sheet separation, the feed roll shaft is only rotated back to its initial or home position while the registration roll continues to rotate until the start of the next feeding cycle.

Figure 3:
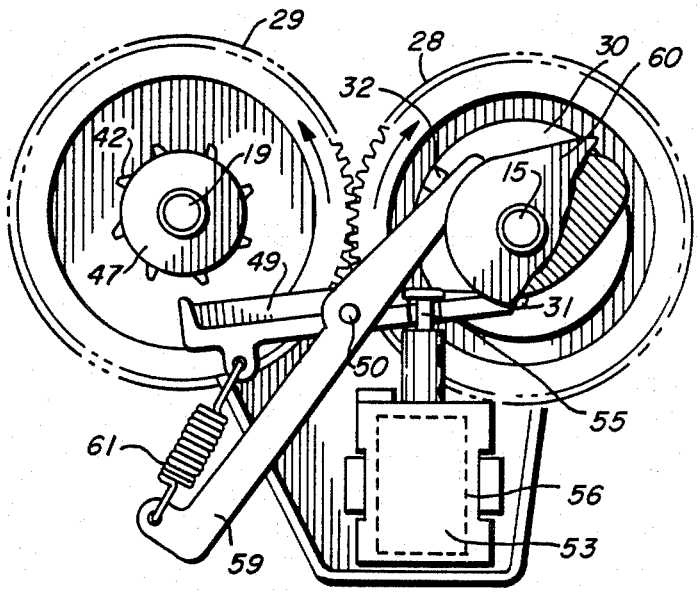
FIG. 3 is an end view of the feed roll and registration roll drive mechanism.
Figure 4:
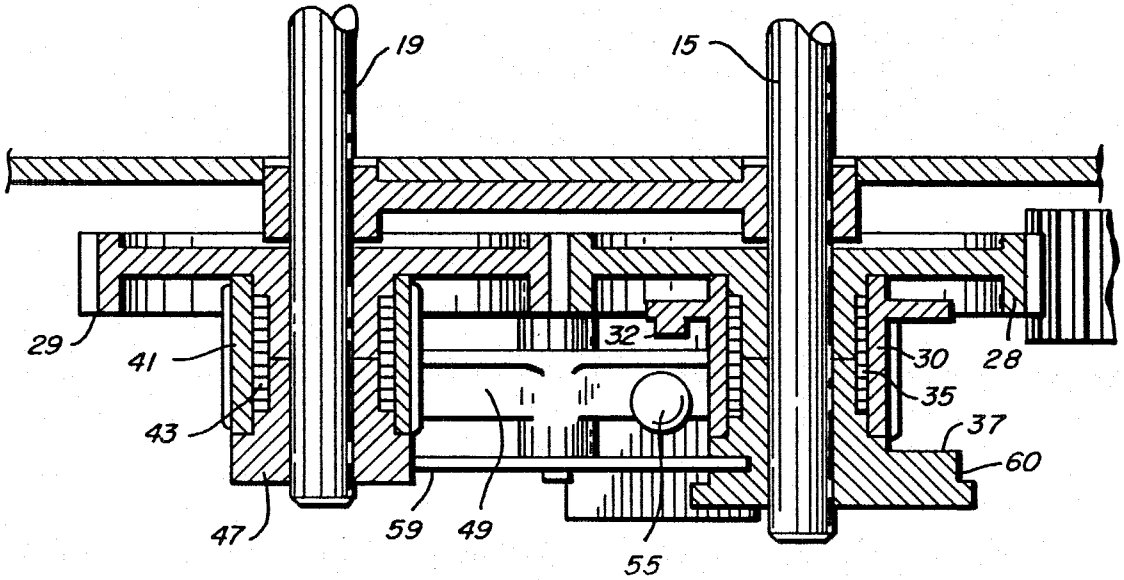
FIG. 4 is a top view of the feed roll and registration roll drive mechanism.
Figure 5:
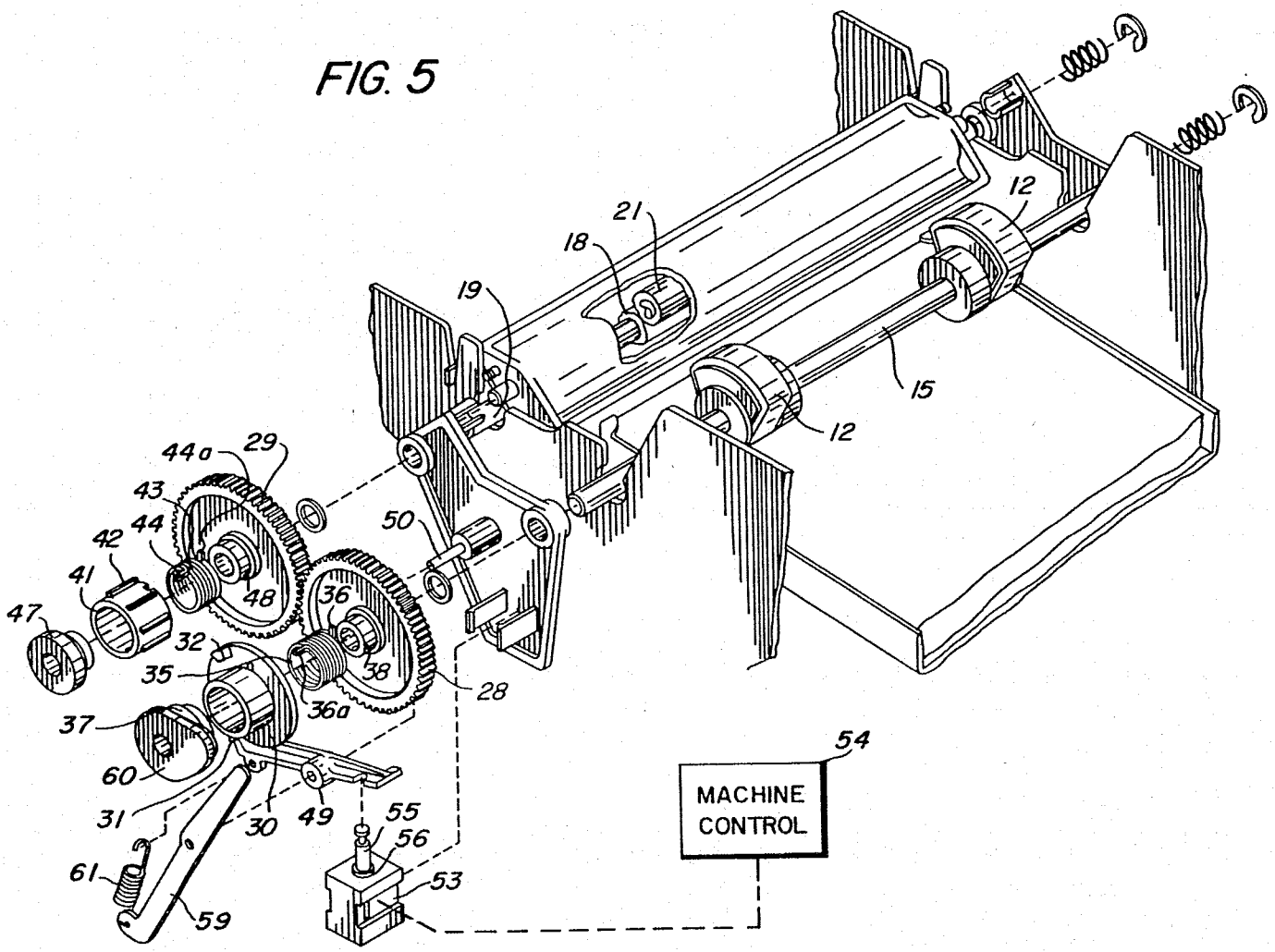
FIG. 5 is an isometric view of the feed roll and registration roll drive mechanism.

The drive assembly for providing the above described stalled roll sheet feed mechanism and operation will now be described with additional reference to FIGS. 3–5. Positive drive capability from the main machine drive to both the feed roll shaft 15 and the registration roll shaft 19 is provided by gears 28 and 29 (See FIG. 3) which with the use of wrap spring control collar arrangement on each shaft can be used to selectively engage both the feed roll shaft and the registration roll shaft in the timed sequence manner described above. The control collars in turn are controlled with an actuator pivotally mounted between the feed roll shaft and the registration roll shaft whose movement is further controlled by a solenoid and a clutch response enhancement feature to be described later.

Turning now to the construction of the feed roll shaft and associated hardware and with continued reference to FIGS. 3–5 the shaft is activated through control ratchet collar 30 having a ratchet stop 31 on its cylindrical surface and a stop 32 on its inboard surface for engagement with one end of the control arm as will be described later. Internal of the ratchet collar is a wrap spring 35 which has a radial tang 36 at one end connected to the control collar and an axial tang **36*a* at the other end connected to the output hub 37 which is fixed to feed roll shaft. It should be noted that a portion of the wrap spring is wrapped around the hub 38 of the feed roll shaft gear 28. This drive system permits you to selectively activate or rotate the output hub 37 and thereof the feed roll shaft based on whether the rotational motion of the control collar 30 is interrupted or not. For example, when positive drive to the output hub is desired, the control collar should be free to rotate whereby the spring will wrap sufficiently tight around the hub 38 to translate the desired motion from the gear to the output hub 37. Conversely when no drive is desired to the output hub 37 then stop 31 or 32 on the feed roll ratchet control collar is engaged and the spring unwraps from the hub of the feed roll shaft gear 38** thereby discontinuing the positive drive to the feed roll shaft.

The actuation of the registration roll shaft is accomplished in exactly the same manner as for the feed roll shaft except that the registration roll ratchet control collar 41 is provided with a plurality of stops 42 evenly spaced along its surface. Interior of the registration roll control collar 41 is a wrap spring 43 which has an axial tang 44 at one end connected to the output hub 47 which is fixed to registration roll shaft 19 and a radial tang **44*a* connected to the registration control collar. As with the feed roll drive construction, a portion of the wrap spring is wrapped around the hub 48 of the registration roll shaft gear 29**. The manner in which positive drive is provided to the registration roll shaft is provided in exactly the same manner as described with reference to the feed roll shaft.

The feed roll and registration roll control mechanism will now be described with continued reference to FIGS. 3–5. The control actuator arm 49 is pivotally mounted about stationary pivot 50 between the feed roll and registration roll shafts with one end engageable with the stops 31, 32 on the feed roll control collar, and the other engageable with any one of the stops 42 on the registration roll control collar. With this pivotally mounted arrangement it will be noted that generally when the stop 31 on the feed roll collar engages the control actuator arm 49 that none of the stops 42 on the registration roll control collar are engaged and vice versa. The exception to this arrangement is the interval between when stop 31 on the cylindrical surface of the feed roll control collar is disengaged to when the stop 32 on the inboard surface of the control collar is engaged when both the feed roll and the registration rolls are being positively driven. The position of the control actuator arm 49 is controlled by solenoid 53 which in turn is selectively energized by the overall machine control mechanism 54. When the solenoid is energized the plunger 55 which is connected to the end of the control actuator arm nearest the feed roll shaft is pulled down into the coil 56 thereby engaging the control arm with one of the ratchet stops 42 on the registration roll control collar 41 and disengaging (with one exception, noted above) the ratchet stop 31 on the feed roll control collar 30. When the solenoid is deenergized the plunger 55 is released from the magnetic field of coil 56, the stop on the registration roll collar is released from engagement with the control actuator arm and the registration roll is driven in a direction to feed the sheet through the nip.

Figure 6:
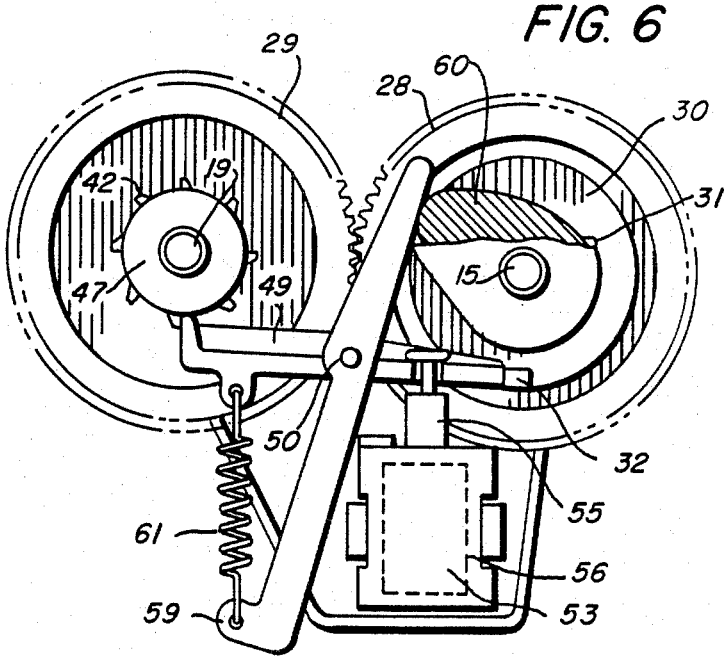
FIG. 6 is an end view of the feed roll and registration roll drive mechanism in position just prior to the solenoid being inactivated.

To provide and enhance the retraction of the control actuator arm 49 from the registration roll control collar a spring lever cam arrangement is provided. A lever 59 also pivotally mounted about control actuator arm pivot 50 has one end which rides on cam surface 60 mounted on the feed roll output hub 37 and the other end connected by spring 61 to the end of the control actuator arm in communication with the stops on the registration roll control collar. As will be appreciated with particular reference to FIG. 6, with the actuator arm 49 engaging one of the stops on the registration roll control collar and the cam 60 providing the greatest extension in the spring 61, when the solenoid is deenergized the actuator arm is positively and forcefully retracted from engagement with a ratchet stop on the registration roll. As a direct result of this spring force amplification feature, the clutch response time as compared to conventional solenoid operated wrap spring clutch assemblies is dramatically improved. In actual test a response time variability distribution of the order of only 35% that of the conventional system has been achieved.

In the operation of the sheet feeding and registration device according to the present invention, once actuated a positive drive is provided to each of the drive gears for the feed roll shaft and the registration roll shaft. The solenoid has not been activated and accordingly the registration roll is being driven by the drive gear for the registration roll. Since the first stop on the feed roll control collar has been engaged by the control actuator arm the feed roll shaft is disabled. To feed a sheet, the solenoid is activated pulling down the control arm portion which has been in engagement with the stop 31 on the feed roll control collar pivoting it down so that the other end of the pivotable control arm engages one of the multiplicity of stops on the registration control collar. The registration roll ceases to rotate while the feed rolls rotate a distance of about 230° until a raised stop 32 on the inboard surface of the control collar comes into engagement with and is intercepted by the retracted portion of the control actuator arm. Simultaneously the cam on the output hub is rotated of the the same distance amplifying the spring force. By this time the lead edge of the top sheet of the stack of paper being fed should have entered the nip between the registration roll and the idler roll and it is held there because the rolls have not been actuated. To register and continue feeding the sheet forward, the voltage on the solenoid goes to zero, the force on the plunger in the solenoid is released, the spring snaps the portion of the control actuator arm in engagement with the registration roll control collar down, and simultaneously the feed roll is released by the actuator arm and from engagement with the second stop 32 on the inboard collar by moving up permitting the stop to pass. The feed roll is thereby driven the remainder of the 360° cycle until the frictional surface is away from the paper and the end of the control arm engageable with the feed roll control collar strikes the feed roll stop 31. The registration roll continues to drive forward and the cam surface is returned back to its ready position for the next feeding cycle.

It will be appreciated that the above described sheet feeding and registration system provides an extremely simple, low cost, highly reliable sheet feeding and registration device. It has the particular advantage of overcoming frictional forces and inconsistent solenoid capacitance at deenergization thereby causing variation in the clutch engagement of the registration roll from sheet to sheet. It also has the advantage of providing a force multiplier that ensures that the registration clutch engagement is consistently carried out. Furthermore, this force multiplier is enacted only at the point when the solenoid pull in force is maximum. In the device according to the present invention a fixed sheet feeding and registration cycle is provided which does not require the presence of sensing switches or other devices or control members to respond thereto. Furthermore by maintaining a short paper path and a fixed distance between the two shafts, the feed roll and the registration roll shaft, only the two controlled collar stops on the feed roll are necessary, no switch being necessary to sense the leading edge of a sheet being fed.

In addition, the present invention provides a sheet feeding and registration device with a relatively low number of simple parts which are easy to make and easy to assemble in a modular form to provide the necessary sheet driven displacement consistency from feed roll to registration roll.

In addition, it will be appreciated that the described device may be modified and varied by the skilled artisan upon a reading of the present disclosure. It is, for example, not limited to use in a xerographic copier but has application generally to sheet feeding including sheets other than paper. Furthermore, while the present invention has been illustrated with a segmented feed roll, it should be understood that it has equal utility with other types of systems. It can, for example, be used with a solid feed roll provided with an additional one way clutching means between the feed roll and the drive shaft to ensure that the feed roll is not feeding simultaneously at all times with the registration roll. This modification, together with other modifications as it may readily occur to the artisan are intended to be within the scope of the appended claims.

What is claimed is:

1. A sheet feeding and registration apparatus comprising a sheet registration roll axially mounted on a drive shaft and a sheet feed roll axially mounted on a drive shaft to separate and feed a sheet from a sheet supply to said registration roll and a drive assembly to drive said feed roll and said registration roll in a predetermined timed sequence, said drive assembly comprising control collars mounted on each of said feed roll shaft and registration roll shaft, means to positively drive each of said feed roll and registration roll, said control collars comprising clutch means to engage and disengage each of said feed roll shaft and registration roll shaft with said drive means, said collars having control stops selectively positioned on their surfaces, means to selectively actuate said clutch means through said control collars comprising:

a control arm pivotally mounted between said feed roll control collar and said registration roll control collar, each end of said control arm having means to respectively engage said control stops on said feed roll and registration roll control collars and solenoid means to selectively pull the end of said control arm adjacent said feed roll down when energized thereby releasing said feed roll control collar;

said drive assembly further including means to positively retract said control arm from engagement with said registration roll control collar when said solenoid is deenergized.

2. The sheet feeding and registration apparatus of claim 1, wherein said means to positively retract said control arm from engagement with said registration roll control collar comprises a spring.

3. The sheet feeding and registration apparatus of claim 2, further including means to multiply the positive retraction force applied to said control arm when it is retracted from engagement with said registration roll control collar.

4. The sheet feeding and registration apparatus of claim 2, wherein one end of said spring means is attached to the end of the control arm in operative association with said registration roll control collar and the other end of said spring is connected to a lever which is pivotally mounted between said feed roll and said registration roll with the opposite end of said lever being a cam follower in operative association with a cam surface on said feed roll output hub to provide an extension in said spring when the solenoid is deenergized thereby providing an additional force to instantly retract the control arm from the control collar on the registration roll shaft when the solenoid is deenergized.

5. The sheet feeding and registration apparatus of claim 1, further comprising an idler roll in driving engagement with said registration roll and forming a registration nip therebetween.

6. The sheet feeding and registration apparatus of claim 5, further including sheet guide means to guide the transport of sheets fed from said sheet supply by said feed roll to said registration nip.

7. The sheet feeding and registration apparatus of claim 1, wherein said clutch means comprises wrapped spring clutches axially positioned on said drive shafts between said shaft and a gear drive also mounted on said shaft.

8. The sheet feeding and registration apparatus of claim 1, wherein said feed roll is a segmented feed roll.

9. The sheet feeding and registration apparatus of claim 1, wherein said feed roll control collar has a first stop provided on its axial surface and a second stop provided on its inboard surface spaced a greater distance from the center than the first control stop.

10. The sheet feeding and registration apparatus of claim 1, wherein said registration roll control collar has a plurality of stops provided on its axial surface uniformly spaced from one another.

11. The sheet feeding and registration apparatus of claim 1, wherein said registration roll control collar has a plurality of stops provided on its axial surface uniformly spaced from one another, one of which is simultaneously engaged by the other end of said control arm when said solenoid means pulls the end of said control arm adjacent the feed roll down.

* * * * *